US008075030B2

(12) United States Patent
Pearson et al.

(10) Patent No.: US 8,075,030 B2
(45) Date of Patent: Dec. 13, 2011

(54) BALL RETRIEVING APPARATUS

(76) Inventors: Robert E. Pearson, Auburn, AL (US); William R. Gwin, Auburn, AL (US)

( * ) Notice: Subject to any disclaimer, the term of this patent is extended or adjusted under 35 U.S.C. 154(b) by 291 days.

(21) Appl. No.: 12/457,406

(22) Filed: Jun. 10, 2009

(65) Prior Publication Data

US 2010/0314893 A1 Dec. 16, 2010

(51) Int. Cl.
*A63B 47/02* (2006.01)

(52) U.S. Cl. ..... 294/19.2; 294/179

(58) Field of Classification Search ..... 294/19.2, 294/55, 179; 414/434, 439, 440; 56/332, 56/333; 15/257.7; 43/12
See application file for complete search history.

(56) References Cited

U.S. PATENT DOCUMENTS

| | | | | | |
|---|---|---|---|---|---|
| 333,173 | A | | 12/1885 | Taylor | |
| 401,360 | A | * | 4/1889 | Marsters | 43/12 |
| 1,109,469 | A | | 9/1914 | Sandberg | |
| 1,271,287 | A | | 7/1918 | Daly | |
| 1,957,944 | A | * | 5/1934 | Dexter | 43/12 |
| 2,277,545 | A | | 3/1942 | Gatley | |
| 2,586,003 | A | | 2/1952 | Caslor | |
| 2,683,949 | A | * | 7/1954 | Berezansky | 43/12 |
| 2,724,610 | A | | 11/1955 | Fitzgerald | |
| 2,817,405 | A | | 12/1957 | Pearson | |
| 2,849,743 | A | * | 9/1958 | McFarland | 15/257.2 |
| 3,593,868 | A | | 7/1971 | Folz | |
| 3,926,464 | A | | 12/1975 | Alexander | |
| 4,252,490 | A | | 2/1981 | Keller | |
| 4,254,981 | A | * | 3/1981 | Wilson | 294/19.2 |
| 4,549,758 | A | | 10/1985 | Meshulam | |
| 4,596,414 | A | | 6/1986 | Mottet | |
| 4,602,401 | A | | 7/1986 | Holroyd | |
| 4,709,440 | A | * | 12/1987 | Conelly | 15/257.3 |
| 4,721,428 | A | | 1/1988 | Rohrer et al. | |
| 4,799,725 | A | * | 1/1989 | Anderson | 294/19.2 |
| 4,844,527 | A | | 7/1989 | Ray | |
| 4,870,773 | A | * | 10/1989 | Schmucker et al. | 43/12 |
| 5,147,100 | A | | 9/1992 | Frankel | |
| D393,300 | S | | 4/1998 | Andrews et al. | |
| 5,771,519 | A | | 6/1998 | Hrunek | |
| 5,868,447 | A | | 2/1999 | Clark et al. | |
| 6,296,575 | B1 | | 10/2001 | Harris | |
| 6,695,370 | B2 | | 2/2004 | Johnson | |
| 7,044,519 | B2 | | 5/2006 | Raguse | |
| 7,341,294 | B2 | | 3/2008 | Olmstead | |

* cited by examiner

*Primary Examiner* — Dean Kramer
(74) *Attorney, Agent, or Firm* — Shlesinger, Arkwright & Garvey LLP

(57) ABSTRACT

The present invention is a foldable device for retrieving golf, tennis, or other balls. The invention comprises an elongated shaft having handles at one end and a pair of elongated arm members hinged to the shaft at an opposite end. When fully deployed, the arm members form a V-shaped collection member adapted to be moved along the surface of a putting green or tennis court to gather scattered balls within a first region of the collection member and then collect the gathered balls within a second region of the collection member for eventual lifting and transport.

16 Claims, 5 Drawing Sheets

BALL RETRIEVING APPARATUS

FIELD OF THE INVENTION

This invention concerns hand held apparatus for collecting and retrieving a number of balls scattered on a surface, for example, a practice green or tennis court.

BACKGROUND OF THE INVENTION

Sports such as golf and tennis require practice in order for a player to improve his or her skills. In golf, this may take the form of putting or chipping golf balls onto a practice green. In the case of tennis, practice often comprises repeatedly serving and volleying tennis balls, with or without a partner. As is apparent, the task of retrieving the scattered balls from a practice green or tennis court is both cumbersome and time consuming.

Although manually operated golf and tennis ball collection devices are known, the prior art devices are inefficient, complicated to operate, bulky in construction or not easily transported.

BRIEF SUMMARY OF THE INVENTION

The present invention is a collapsible device for retrieving golf, tennis, or other balls, the device comprises an elongated handle member provided with hand grips at one end and a V-shaped collection member at an opposite end, the collection member comprising a pair of foldable arm members that are hinged together at the handle member at one end thereof and including a collapsible brace member near an opposite ends thereof, the collapsible brace member generally extending transverse to the foldable arm member to interconnect the same whereby the arm members are adapted to be secured into an open position having first and second regions for gathering and collecting balls, the second region including a sheet of netting, cloth or other material.

DETAILED DESCRIPTION OF THE INVENTION

Figure 1:
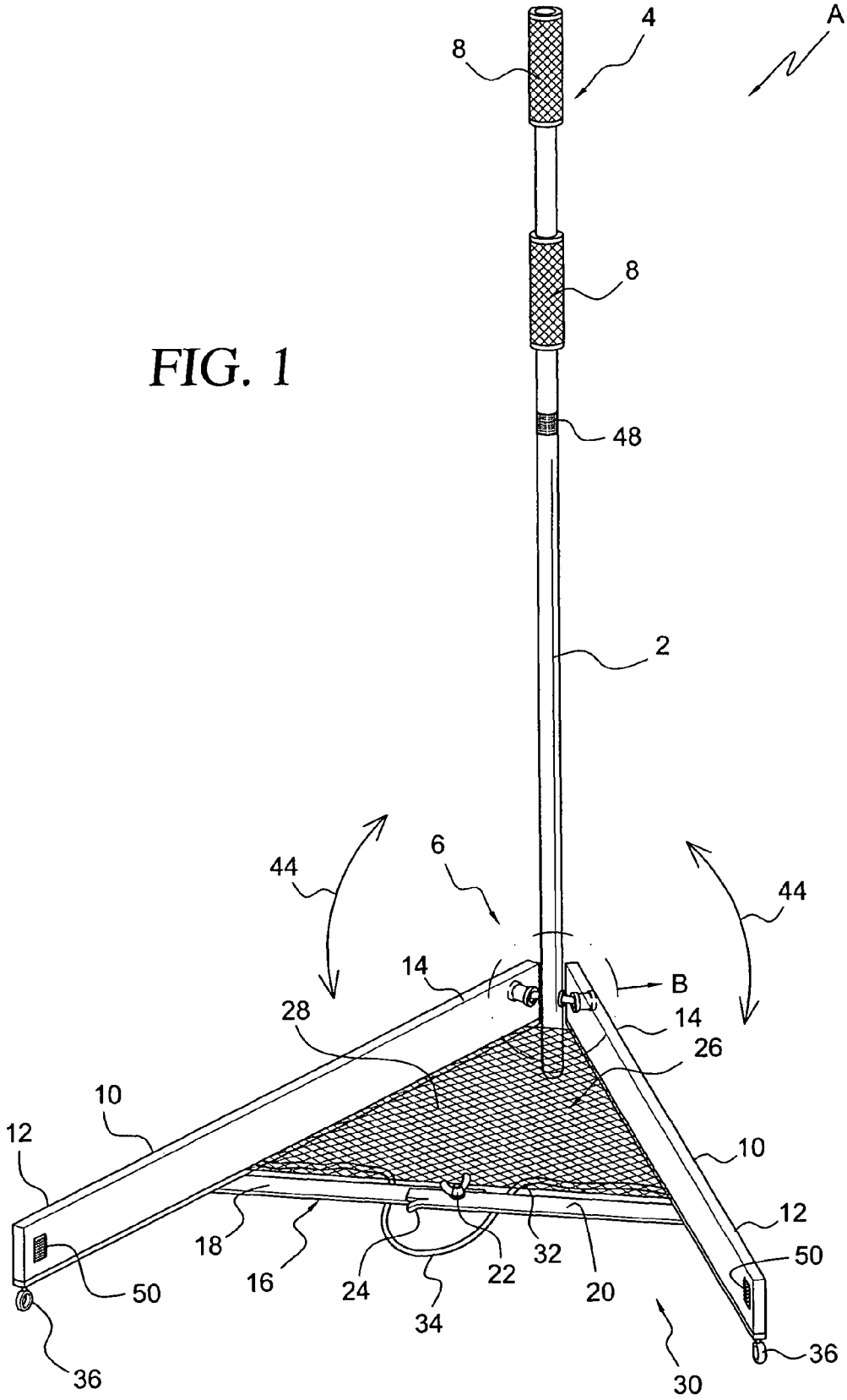
FIG. 1 is a perspective of a ball retrieving apparatus according to the present invention.
Figure 2:
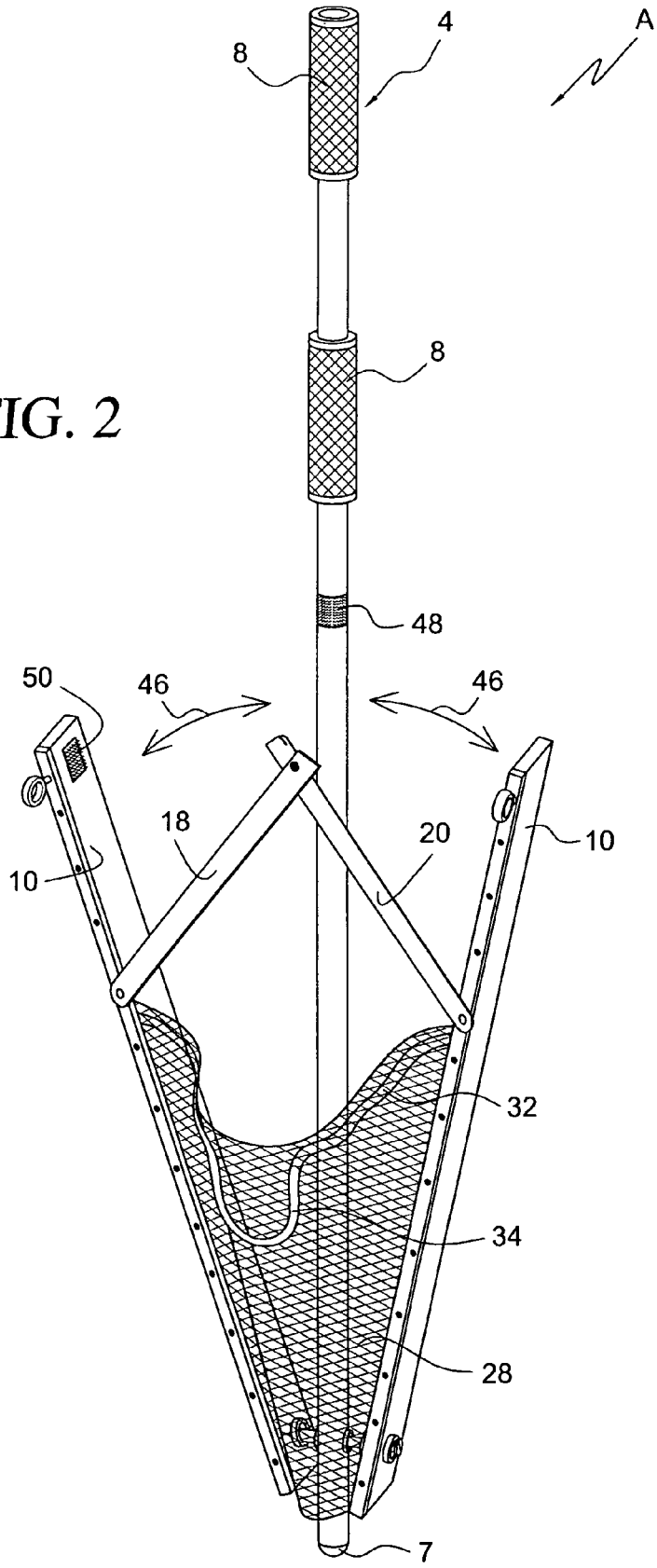
FIG. 2 is a perspective of the ball retrieving apparatus shown in FIG. 1 when in a partially folded position.
Figure 3:
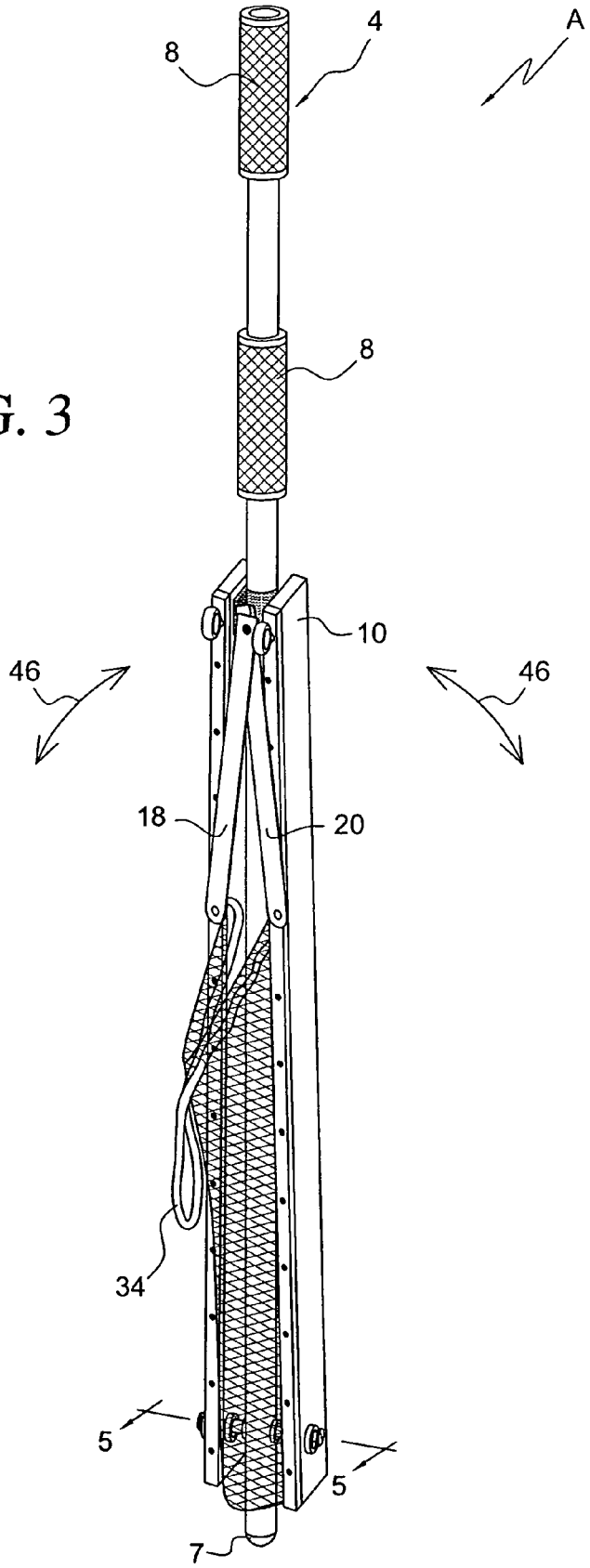
FIG. 3 is a perspective of the ball retrieving apparatus shown in FIG. 1 when in a fully folded position.
Figure 4:
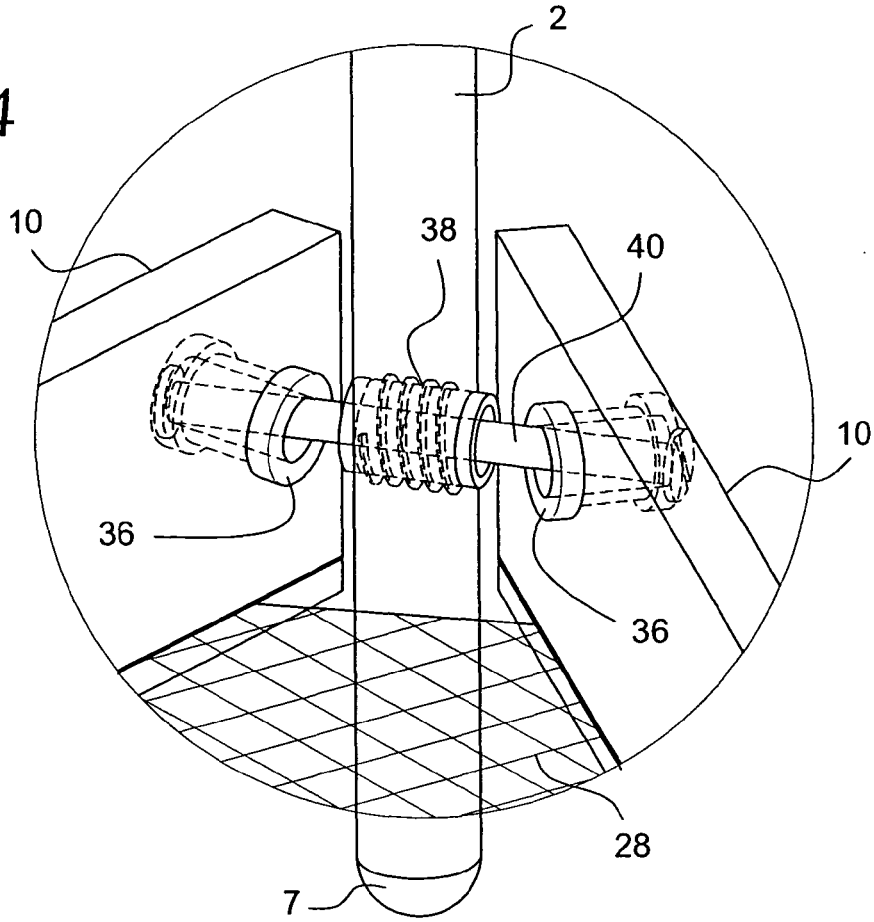
FIG. 4 is an enlarged view of the hinge member shown within area B of FIG. 1.

Turning to FIG. 1, the ball retrieving apparatus A according to the present invention is shown when in a fully deployed position. The apparatus has a central shaft member 2 having a top end region 4 and bottom end region 6. As best shown in FIGS. 2, 3 and 4, a smooth, hard, convex end cap 7 is provided at the terminus of bottom end region 6. The end cap 7 is provided to resists wear against the bottom of the shaft member 2 during use of the device.

A pair of hand grips 8 is secured to the shaft member 2 along the top end 4 of shaft 2. As is apparent, the device A is operable without hand grips 8 and it is within the scope of the invention to provide other gripping members. For example, gripping regions may be integrally formed within the top end of the shaft member 2.

A pair of cooperating arm members 10 are connected at the bottom end 6 of shaft 2. Each of the arm members 10 has a first end 12 and second end 14.

A collapsible brace member 16 extends between the arm members 10 to maintain the arm members in a V-shaped open position during operation of the device. When in an open position, the arm members 10 in combination with the brace member 16 form a ball collection member having first and second regions for respectively gathering and collecting balls. Brace member 16 comprises a pair of hinged legs 18 and 20 adapted to be locked into an open and fixed position. One leg 18 of brace member 16 is pivotally secured (not shown) at its first end to the underside of one of the arm members 10 and at a location approximately two thirds of the way between the first end 12 and second end 14 of arm member 10. A second leg 20 of brace member 16 is pivotally secured (not shown) at its first end to the underside of the other of the arm members 10 and also at a location approximately two thirds of the way between the first end 12 and second end 14 of arm member 10.

As best shown in FIG. 1, a connection member 22 in the form of a wing nut with screw, interconnects brace legs 18 and 20 at their respective second ends. Other types of fasteners are within the scope of the present invention so long as they secure the brace member 16 in a fixed or deployed position as will be fully explained below. In the embodiment shown in FIG. 1, brace leg 20 includes a stop member 24 for limiting the range of motion of brace member 16 between its open and collapsed positions.

As is apparent, other collapsible brace members are within the scope of the present invention so long as, when deployed, it maintains the arm members 10 in an open position and it does not interfere with folding of the apparatus. For example, the arms of the brace member could extend telescopically or via pneumatic piston members.

The region between the shaft member 2, arm members 10 and brace member 16 forms an equilateral triangle when the device is fully deployed and as best shown in FIG. 1. As is apparent, the device will nevertheless function when the angle between any two sides is greater than or less than sixty degrees. In one embodiment, brace member 16 is positioned approximately thirteen inches from the hinge region identified as B in FIG. 1. That distance is preferred when the device is primarily used for collecting golf balls. When the device is primarily used for collecting tennis balls, the preferred distance between the brace member 16 and the hinge region B is about twenty five inches. Either distance will enable the device to function for collection of both golf and tennis balls. The preferred distances between the brace member and the hinge region provide a larger or smaller collection region 26.

Returning to FIG. 1, collection region 26 includes a two ply layer of nylon netting or mesh material 28 having a triangular shape and being secured to each of the arm members 10. It is within the scope of the invention to use a sheet material formed from a different material such as, for example, cloth or plastic. The area forward of the brace member 16 and between arm members 10 is a gathering region 30 that will be further described below.

A strap or length of cord 32 formed from nylon or another resilient material is secured to a side of the mesh material 28 adjacent brace member 16 and forms a loop 34 or lifting handle as best shown in FIG. 2. A pair of wheels or castors 36 is secured to the undersides of arm member 10 and at the first ends 12.

Figure 5:
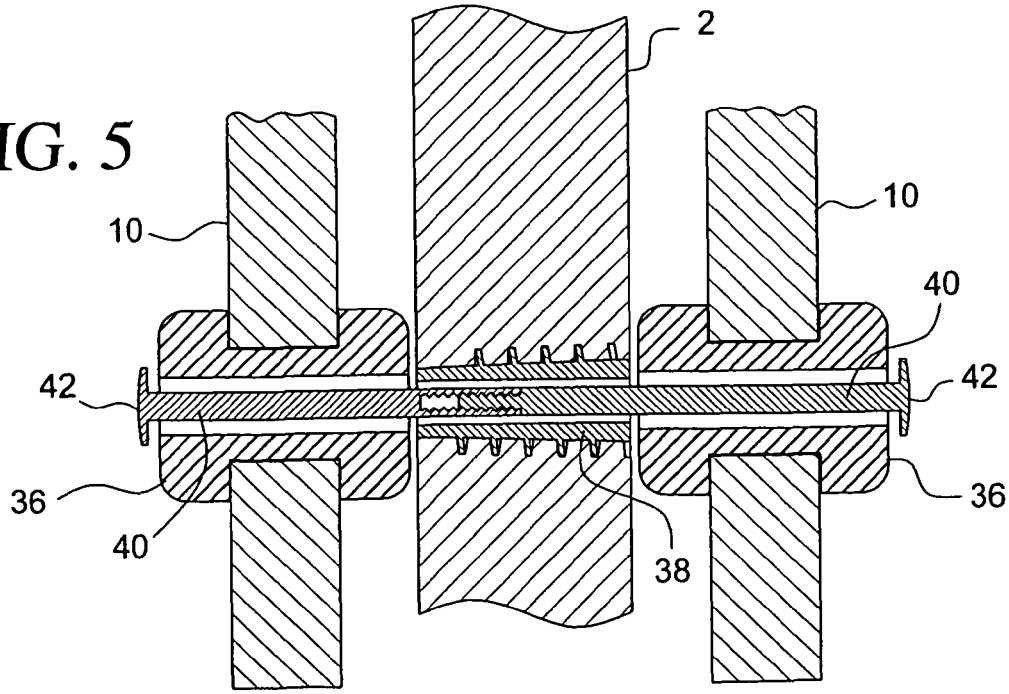
FIG. 5 is an enlarged view of the hinge member taken along lines 5-5 in FIG. 3.

Turning to FIGS. 4 and 5, hinge region B is shown in greater detail. Arm members 10 are secured to shaft member 2 by a pair of grommet members 36, each of which extends through a separate one of the pair of arm members 10. An insert nut 38 is shown to extend through the shaft member 2. A post screw 40 having end caps 42 extends through the insert nut 38 and though each of the grommets 36. This arrangement allows the arm members 10 to pivot upwardly and downwardly relative to shaft member 2 and in a direction as indicated by arrows 44 of FIG. 1. The arrangement also allows the arm member 10 to pivot toward shaft member 2 and in a direction as indicated by arrows 46 of FIG. 2.

In a preferred embodiment, the length of the post screw 40 is about two and one quarter inches for a golf ball lifting device and two and a half inches for a tennis ball lifting device. It is within the scope of the present invention to provide other lengths for the post screw depending upon the nature of the balls to be collected.

Additional features include hook and loop connector strips 48 and 50, sold under the trademark VELCRO, which are provided on shaft member 2 and arm members 10 and as best shown in FIG. 1. These connectors maintain the device in a folded position as will be further explained below.

Turning to FIG. 3, the ball retrieving apparatus of the present invention is seen in a fully folded position. To unfold the device for use, the VELCRO strips 50 are separated from VELCRO strip 48 disposed on shaft member 2. This enables the arm members 10 to swing outwardly and away from shaft member 2 as best by arrows 46 in FIG. 2 and into a fully expanded position so that brace legs 18 and 20 can be interlocked together by rotating connection member or wing nut 22.

The fully expanded arm members 10 are then rotated downwardly in the direction of arrows 44 of FIG. 1 and into an operational position whereby the arm members 10 extend generally transverse to the longitudinal axis of shaft member 2.

Figure 6:
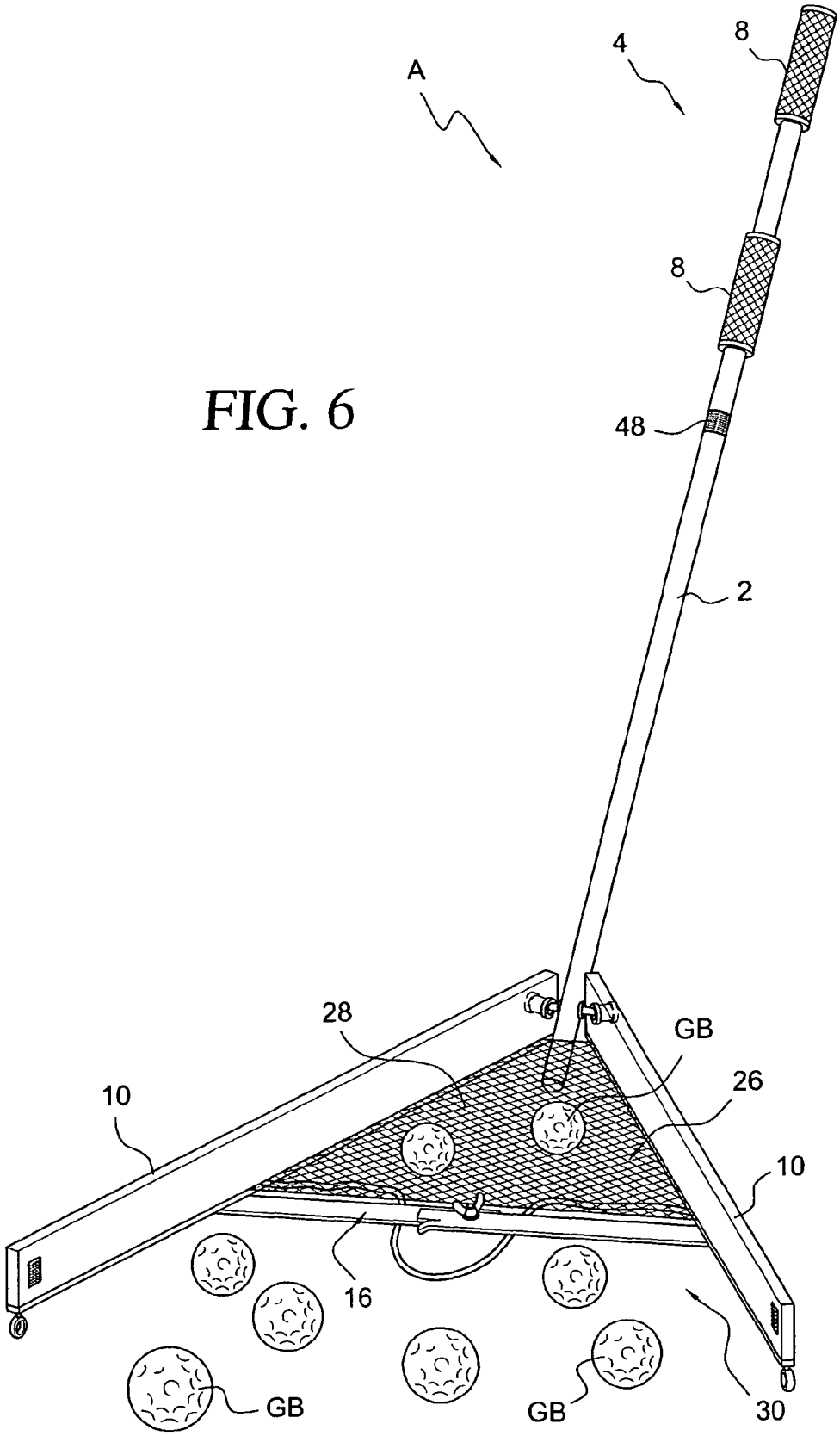
FIG. 6 is a perspective of the ball retrieving apparatus according to the present invention when in use.

As best shown in FIG. 6, a number of golf balls GB scattered along a surface may be collected by grasping the shaft 2 at hand grips 8 and wheeling the device so that the open faced gathering region 30 is moved adjacent the golf balls GB where they can be deposited within collection region 26 by brushing them in by hand, foot or using a tennis racquet of golf club.

After a number of balls have been accumulated within collecting region 26, the user grasps handles 34 and lifts the group of collected balls so that they may be carried to a separate location for deposit (not shown).

The present invention permits collection of about two dozen golf balls or three dozen tennis balls scattered along a surface. Collection is easily achieved as the device may be conveniently wheeled along the ground to the balls where they may be manually brushed into the collection region 26. After use, the device is easily returned to a folded position by loosening the brace connection member and swinging the arm members upwardly and against the shaft for securement by connectors 48 and 50.

While this invention has been described as having a preferred design, it is understood that it is capable of further modifications, and uses and/or adaptations following in general the principle of the invention and including such departures from the present disclosure as come within the known or customary practice in the art to which the invention pertains, and as may be applied to the central features hereinbefore set forth and within the scope of the invention.

We claim:

1. A ball retrieving apparatus comprising:

a) an elongated shaft having top and bottom ends;

b) a pair of arm members hingedly mounted at one end thereof to said shaft bottom end;

c) a collapsible brace extending between said pair of arm members and connected thereto whereby said arm members are adapted to be fixed into a generally V-shaped configuration defining a first region; and d) a platform extending between said arm members and said collapsible brace and connected to at least said arm members to provide a second region whereby balls scattered on a surface may be gathered within said apparatus first region and deposited within said second region;

e) a lifting handle, said lifting handle disposed between said pair of arm members and at said second region; and f) a post member having first and second ends, said post member extends through said elongated shaft bottom end and is axially rotatable therein, one of said post member ends extending through one of said pair of arm members and the other of said post member ends extending through the other of said pair of arm members and axially rotatable therein so that pair of arm members are adapted to pivot between a plane substantially transverse to the longitudinal axis of said shaft and a plane within the longitudinal axis of said shaft wherein each of said pair of arm members having a grommet through which said post member extends and is retained for axial rotation therein.

2. A ball retrieving apparatus as in claim 1 and wherein said platform is formed from a sheet material.

3. A ball retrieving apparatus as in claim 2 and wherein said sheet material is a flexible mesh sheet.

4. A ball retrieving apparatus as in claim 1 and wherein said lifting handle is a loop having first and second ends thereof, one of said loop first and second ends secured to one of said pair of arm members.

5. A ball retrieving apparatus as in claim 1 and wherein said collapsible brace comprising a pair of brace leg members having first and second ends thereof, each of said pair of brace leg members pivotally secured at said first end thereof to one of said pair of arm members and pivotally secured at a second end thereof to the other of said pair of brace leg members, said pair of brace leg member second ends are adapted to be secured together into a locked position.

6. A ball retrieving apparatus as in claim 5 and further including:

a) a nut and bolt, said nut and bolt operatively associated with said pair of brace leg member second ends thereof for locking said brace into a non-collapsed position.

7. A ball retrieving apparatus as in claim 5 and further including:

a) a stop member, said stop member provided on one of said pair of brace leg member second ends for limiting the pivoting range of said pair of brace leg members to no more than about 180 degrees there between.

8. A ball retrieving apparatus as in claim 7 and wherein said stop member is a detent.

9. A ball retrieving apparatus as in claim 1 and wherein the area within said second region forms an equilateral triangle.

10. A ball retrieving apparatus as in claim 1 and further comprising:

a) a pair of handle members, said pair of handle members disposed on said elongated shaft at said top end thereof.

11. A ball retrieving apparatus as in claim 1 and further comprising:

a) hook and loop fastener devices, said hook and loop fastener devices operatively associated with said shaft and pair of arm members for securing said pair of arm members to the shaft.

12. A ball retrieving apparatus as in claim 1 and wherein each of said pair of arm members having a wheel member at one end thereof.

13. A ball retrieving apparatus comprising:

a) an elongated shaft having top and bottom ends;

b) a pair of arm members pivotally mounted at one end thereof to said shaft bottom end;

c) a brace member, said brace member extending between said pair of arm members and adapted to maintain said pair of arm members in an open position having a generally V-shaped configuration and a folded position where said pair of arms are parallel to each other;

d) a flexible collection platform extending between said pair of arm members whereby balls scattered on a surface may be gathered by said pair of arm members when in the open position and caused to be deposited within said collection platform; and e) a lifting handle, said lifting handle secured to said flexible collection platform.

14. A ball retrieving apparatus as in claim 13 and wherein said brace member comprising a pair of legs having first and second ends thereof, each of said pair of legs pivotally secured at said first ends thereof to one of said pair of arm members and pivotally secured at second ends thereof to the other of said pair of legs, said pair of legs adapted to be locked when said pair of arm members are in the open position.

15. A ball retrieving apparatus as in claim 13 and wherein said pair of arm members provided with a pair of rollers for conveying said apparatus along a surface.

16. A ball retrieving apparatus as in claim 13 wherein said lifting handle is a strap.

* * * * *